US007004712B2

(12) United States Patent
Martin

(10) Patent No.: US 7,004,712 B2
(45) Date of Patent: Feb. 28, 2006

(54) TOOL FOR EXCHANGEABLY FASTENING AN IMPLEMENT TO AN EXCAVATOR BOOM

(76) Inventor: Dietmar Martin, Im Seiler 4, Braz (AT) A-6751

( * ) Notice: Subject to any disclaimer, the term of this patent is extended or adjusted under 35 U.S.C. 154(b) by 49 days.

(21) Appl. No.: 10/398,981

(22) PCT Filed: Oct. 8, 2001

(86) PCT No.: PCT/EP01/11623

§ 371 (c)(1),
(2), (4) Date: Apr. 10, 2003

(87) PCT Pub. No.: WO02/31271

PCT Pub. Date: Apr. 18, 2002

(65) Prior Publication Data

US 2004/0028515 A1 Feb. 12, 2004

(30) Foreign Application Priority Data

Oct. 10, 2000 (AT) ..... A 1720/2000

(51) Int. Cl.
*E02F 3/36* (2006.01)

(52) U.S. Cl. ..... 414/723; 37/468

(58) Field of Classification Search ..... 414/723; 37/468

See application file for complete search history.

(56) References Cited

U.S. PATENT DOCUMENTS 4,881,867 A 11/1989 Essex et al.
5,465,513 A * 11/1995 Sonerud ..... 414/723 X
6,379,075 B1 * 4/2002 Shamblin et al. ..... 414/723 X

FOREIGN PATENT DOCUMENTS

| | | |
|---|---|---|
| DE | 29705609 | 7/1997 |
| DE | 29810750 | 10/1998 |
| DE | 19806057 | 9/1999 |
| EP | 0058058 | 8/1882 |
| EP | 0468771 | 3/1995 |
| EP | 0625613 | 8/1996 |
| NZ | 250811 | 6/1997 |
| WO | 8802421 | 4/1888 |
| WO | 9301366 | 1/1993 |
| WO | 9728314 | 8/1997 |
| WO | 0070155 | 11/2000 |

* cited by examiner

*Primary Examiner*—Donald W. Underwood
(74) *Attorney, Agent, or Firm*—Volpe and Koenig, P.C.

(57) ABSTRACT

The invention relates to an assembly for exchangeably fastening an add-on, for example an excavator shovel (2), to an excavator boom (3), whereby retaining bolts (4, 5) spaced apart (A) in parallel are disposed on the excavator shovel (2). Said retaining bolts (4, 5) can be gripped by grippers (6, 7) mounted on the excavator shovel (3) that can be hydraulically adjusted relative to each other. Said grippers (6, 7) have open insertion openings (8, 9) for the retaining bolts (4, 5) in directions facing away from each other. The longitudinal axis (10) of the hydraulic drive (11) for adjusting the grippers (6, 7), the center axis (12, 13) of the retaining bolts (4, 5) and the center axis (14, 15) of the insertion openings (8, 9) on the grippers (6, 7) are at least approximately arranged in one plane (16). One gripper (6) is retained in parallel to the axis of the drive (11) in a guide (17) and can be linearly displaced. The parts of the hydraulic or pneumatic drive (11), namely the cylinder (20) and the piston (21) are firmly linked with the grippers (6, 7) (FIG. 2).

6 Claims, 4 Drawing Sheets

TOOL FOR EXCHANGEABLY FASTENING AN IMPLEMENT TO AN EXCAVATOR BOOM

DESCRIPTION

The invention relates to an assembly for exchangeably fastening an add-on, for example an excavator shovel, to an excavator boom or a vehicle, whereby two retaining bolts spaced apart in parallel are disposed on the add-on, which retaining bolts can be gripped by grippers adjustable relative to each other and disposed on a mounting bar on the excavator boom or the vehicle and operable via an hydraulically or pneumatically operated drive, whereby the grippers have insertion openings for the retaining bolts in directions facing away from each other, and whereby the longitudinal axis of the hydraulic or pneumatic drive for adjusting the grippers, the center axis of the retaining bolts and the center axis of the insertion openings on the grippers are, at least approximately, arranged in one plane.

An assembly of this kind can be used meaningfully for all add-ons to be coupled to an excavator boom or to a vehicle, such as excavator shovels, excavator shields, snow removal shields, tools etc. In the area of the assembly for exchangeably fastening the add-on there occur relatively large forces which must be absorbed by this assembly.

A device for exchangeably fastening a tool-type add-on on the front end of an excavator stem as known from the EP-A-0625613 provides for the insertion openings of two grippers to be aligned such that they are offset from one another by approx. 90°. After threading one of the grippers into one of the retaining bolts the entire assembly is pivoted about this retaining bolt until the other gripper with the insertion opening at right angles to it grips the other retaining bolt. The insertion opening of the second gripper can now be blocked by means of an hydraulically displaceable locking element. All the forces act upon the locking element.

Another tool-change device for hydraulic excavators known from the WO97/28314 suggests one fixed and one pivotable gripper. Here again a high torque acts upon the displaceable gripper, which in particular, increases during operation of the excavator.

A further assembly on an excavator is disclosed in the WO88/02421, where one of the grippers is constructed in two parts and is therefore formed by one fixed stop and one displaceable locking member which can be adjusted via a hydraulic unit laterally offset relative to the two grippers. The hydraulic unit with cylinder and piston must be pivotably mounted via bolts at both ends, since this must perform a pivoting movement when the locking member is displaced.

A further quick-change device for an excavator shovel to be attached to an excavator boom is known from the EP-A-0058058, which on the one hand, comprises a gripper which can be pressed against a correspondingly shaped ledge. On the other hand a hook-like part is arranged on the boom, which has an opening facing in the direction of the hydraulic drive with a sloping boundary surface on one side. A clamp plate disposed on the piston of the hydraulic drive has a sloping boundary surface running in parallel, which two sloping boundary surfaces interact to perform a locking and tensioning operation. Here again it is imperative that the cylinder of the hydraulic drive is movably suspended.

In a further coupling device known from the EP-A-0468771 two pairs of couplings are always required, of which one gripper element is fixed and the other gripper element is held displaceably by an hydraulic drive. The displaceable gripper elements associated with the two pairs of couplings are linked with each other via a connection element so that they can be simultaneously operated by the hydraulic drive. A design of this kind is expensive and, due to the long connection bracket required, hardly strong enough to withstand the forces occurring.

A further quick-change assembly of the kind mentioned in the beginning and known from the U.S. Pat. No. 5,465,513 provides for a hydraulic unit with piston and cylinder between a fixed and a displaceable gripper, whereby this unit is linked with the grippers in the customary manner via pivot pins. This arrangement results in force components acting in all sort of directions and further, the manufacture, assembly and rough work on building sites is disadvantageous for a design of this kind.

The invention is therefore based on the requirement to provide an assembly of the kind mentioned in the beginning which permits a quick and easy exchange of add-ons and where, in particular, the introduction and thereby the transmission of forces between boom or vehicle and add-on can be optimised.

According to the invention this is achieved in that one gripper is fixedly and non-displaceably disposed on the mounting bar of the excavator boom or the vehicle and the cylinder of the hydraulic or pneumatic drive is firmly linked with said mounting bar and thus with said gripper, and in that the adjustable gripper is firmly linked with the piston of the hydraulic or pneumatic drive, whereby the guide for said gripper is formed by plates disposed in pairs on both sides, which are arranged in parallel to each other and in parallel to the direction of the axis of the drive.

Due to these measures according to the invention, the transmission of forces between the mounting bar of the boom or the vehicle and the add-on can be effected directly via the bolts and the grippers without the hydraulic or pneumatic drive having to absorb large forces. All that is required is that the hydraulic or pneumatic drive must retain the two grippers at an appropriate distance relative to each other. This tension force goes directly into the centre of the drive and thus into the centre of the piston and also the cylinder. Since there is only one linearly displaceable gripper and all displaceable and forces-absorbing parts are, at least approximately, arranged in one and the same plane, the introduction and transmission of forces can be optimised. There are practically no transverse forces or a torque acting upon the drive since the parts of the hydraulic or pneumatic drive are firmly linked with the grippers, so that it is possible, also from a constructional point of view, to provide a rigid connection between the elements of the hydraulic or pneumatic drive and the grippers which is optimal.

Due to the optimal design of the guide for the displaceable gripper it is possible, from a constructional point of view, to additionally enhance the optimal transmission of forces. The displaceable gripper in the guide in particular, can be subjected to an appropriate load via a torque, whereby this special guide prevents the transmission of forces onto the hydraulic or pneumatic drive. This fact in particular has led to the constructively unique possibility to firmly link the parts of the hydraulic or pneumatic drive with the grippers. For it means that no transverse forces or bending moments can act upon the parts of the drive.

Thus it is possible to provide for a very simple construction and also for a simple of way of fastening the drive or the parts thereof, since the drive is not acted upon by a torque, only by forces acting in direction of the axis, and here only by forces which are needed to retain the grippers in the operating position.

One particular design provides for one of the grippers to be part of a mounting bar forming a constructional element, whereby the cylinder of the hydraulic or pneumatic drive is firmly screwed onto an inserted crossbar. Thus a simple but accurate manufacture and assembly is possible without having to carry out subsequent adjustments. This also obviates the need for fitted bolts or bearing eyes for the drive.

Furthermore it is advantageous if the fixed gripper is formed by two plates spaced apart in parallel, which are provided with corresponding insertion openings for positively locking onto the retaining bolt. These side plates not only ensure a special stability of the crossbar gripping the add-on, but a constructional element is thereby created which permits easy fitting onto the add-ons and an optimal transmission of forces between boom or vehicle and the add-on.

Furthermore it is proposed to form cut-outs in the shape of circular arcs at the ends of the plates opposite the insertion openings as a support for the other retaining bolt. Thus optimal contact is possible immediately the excavator boom or the vehicle drives against the add-on. The crossbar therefore is already correctly positioned relative to the add-on, before the hydraulic or pneumatic drive is activated. It then, practically, only remains for the drive to ensure that this already set-up position is properly locked.

A further advantageous measure results from the fact that the hydraulic or pneumatic drive is disposed between the two plates spaced apart in parallel. The plates thus cover the hydraulic or pneumatic drive on both sides, so that this is not exposed to the rough work on building sites neither before joining it with the add-on nor after the mutual coupling operation. It is therefore practically impossible, with the construction according to the invention, to damage the only sensitive component left, i.e. the piston rod.

Furthermore, a simple constructional variant is created in that a piston rod linked with the piston of the hydraulic or pneumatic drive is shaped as a threaded bolt on its free end and screwed into a threaded bore on the rear of the gripper. A simple construction and assembly of all the parts of the drive has thus been made possible simply because one gripper is shaped as part of the plates, because the cylinder of the drive is firmly linked with said gripper and because the second gripper again is displaceably guided in these plates.

An advantageous constructional measure is also seen in the fact that all lines and unlockable non-return valves are integrated in a block formed, a.o., by the cylinder of the hydraulic or pneumatic drive, whereby only two connection elements for the pressure lines are left leading to the outside. Due to these constructional measures all parts of the hydraulic or the pneumatic unit endangered in the rough work on building sites can be housed within a single block and thus be protected against mechanical damage. Since only a relatively short path is necessary for locking the grippers with the retaining bolts and the cylinder of the drive is neither displaced nor pivoted, no problems result even for the necessary connection elements or for the pressure line since mechanical interference is practically impossible.

Further features according to the invention and special advantages will now be explained in more detail in the description below with reference to the drawings, in which FIG.1 shows an excavator boom with added-on excavator shovel, whereby the assembly for exchangeably fastening the shovel has been partially cut open;

Figure 1:
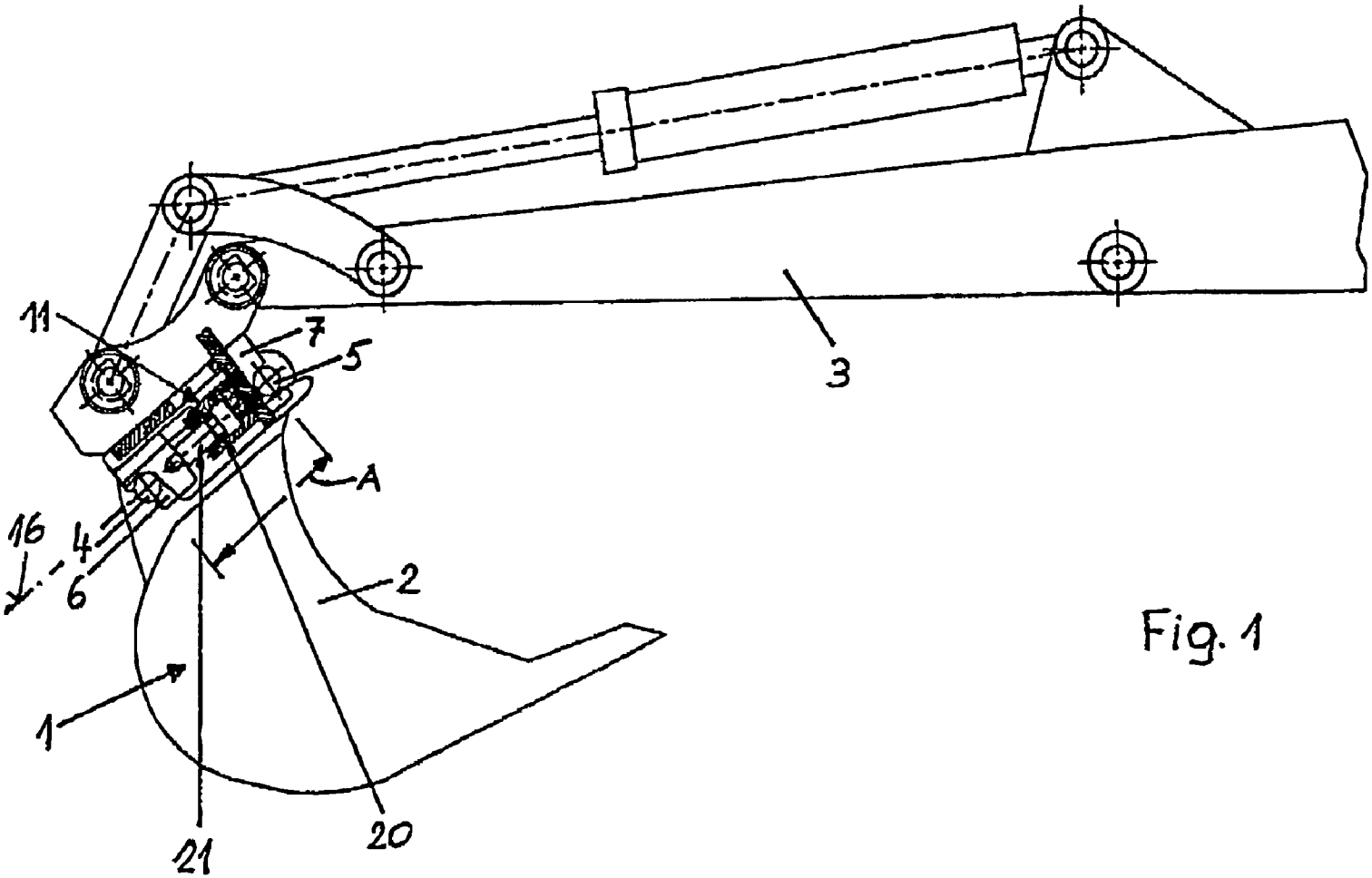
Figure 2:
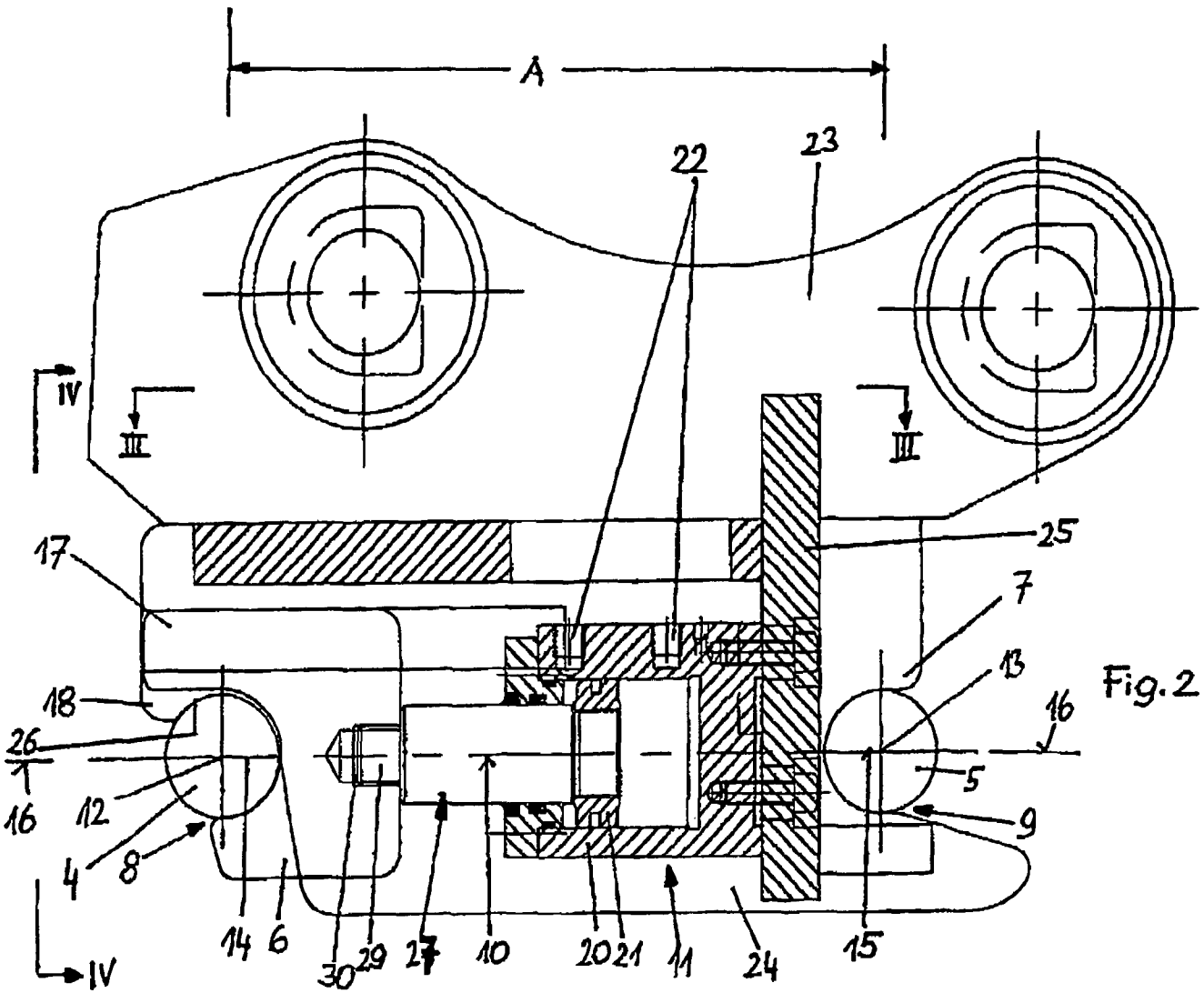
FIG. 2 shows an enlarged side view relative to FIG. 1 of the assembly according to the invention.
Figure 3:
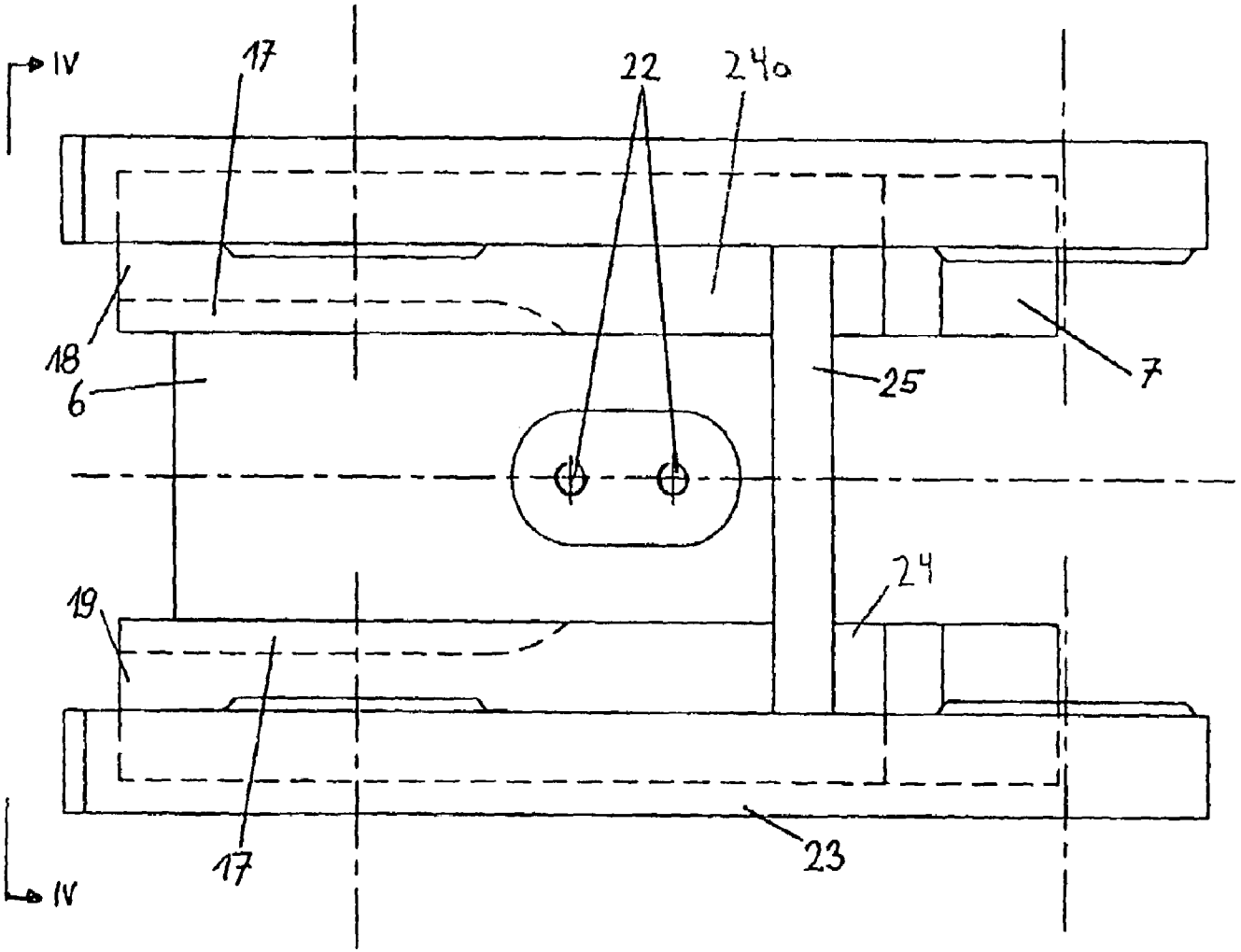
FIG. 3 shows a view of the assembly without add-on along line III—III in FIG. 2.
Figure 4:
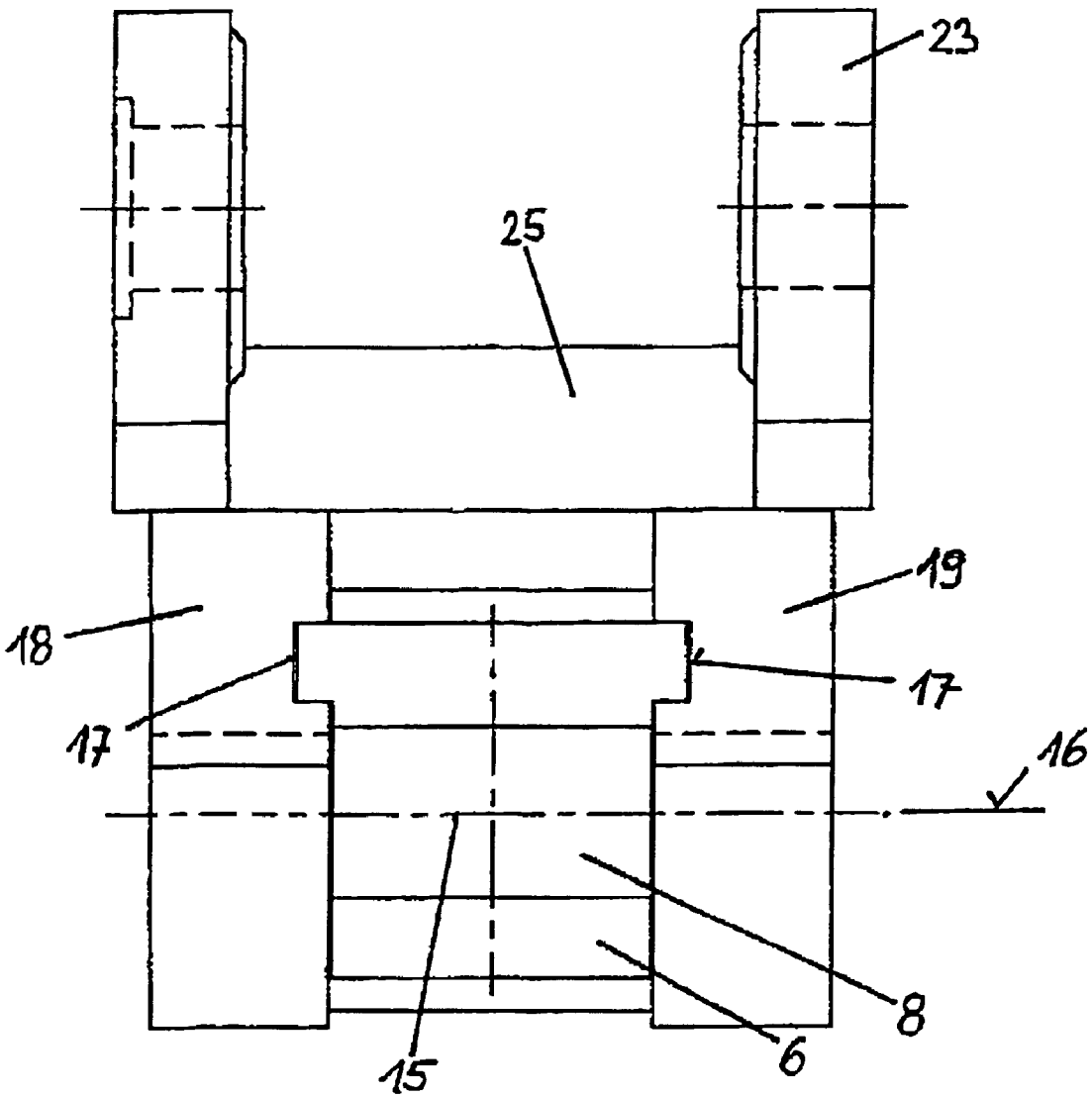
FIG. 4 shows a view of the assembly without add-on along line IV—IV in FIG. 3.

In the description an excavator boom with an excavator shovel as add-on is explained with reference to the drawings. The assembly according to the invention can, of course, be used in all cases where any add-ons such as shovels, shields, tools, load-bearing elements, grippers, driven elements and tools etc. can be quickly fastened to another part, for example an excavator boom, a vehicle, a machine tool, a communal vehicle etc. or also quickly exchanged. Furthermore only an hydraulic drive is discussed in the following although pneumatic and possibly even electrical or mechanical drives may be employed within the framework of the invention.

Here an assembly for exchangeably fastening an add-on 1, in this case an excavator shovel 2, to an excavator boom 3 is discussed. Two retaining bolts 4, 5 spaced apart (A) in parallel are disposed on the add-on 1. These retaining bolts 4, 5 can be gripped by grippers 6, 7 mounted on the excavator boom 3 that can be hydraulically adjusted relative to each other. The grippers 6, 7 have open insertion openings 8, 9 for the retaining bolts 4, 5 in directions facing away from each other.

One measure consists in that the longitudinal axis 10 of hydraulic drive 11 for adjusting the grippers 6, 7, the center axes 12, 13 of the retaining bolts 4, 5 and the center axes 14, 15 of the insertion openings 8, 9 are arranged at least approximately in one plane 16. At least one gripper 6 is retained in parallel to the axis of drive 11 in a guide 17 so as to be linearly displaceable. This guide 17 for said gripper 6 is formed in plates 18, 19 disposed in pairs on both sides, whereby these plates are arranged in parallel to each other and in parallel to the direction of the axis of drive 11.

One gripper 7 therefore is firmly and non-displaceably disposed on the mounting bar 23 of excavator boom 3, and the cylinder 25 of the hydraulic or pneumatic drive 11 is firmly linked with said mounting bar 23 and thus with said gripper 7. The adjustable gripper 6 is firmly linked with the piston 21 of the hydraulic or pneumatic drive 11, whereby the guide 17 for said gripper 6 is formed by plates 18, 19 disposed in pairs on both sides which are arranged in parallel to each other and in parallel to the direction of the axis of drive 11.

Said gripper 7 is part of mounting bars 24, 24*a* forming a constructional element, whereby cylinder 20 of the hydraulic or pneumatic drive 11 is connected to an inserted crossbar 35 using threaded fasteners. Said fixed gripper 7 is formed by the two plates 18, 19 spaced apart in parallel with corresponding insertion openings 9 for positively locking onto retaining bolt 5. Cut-outs (26) shaped in the form of circular arcs are formed on the ends of plates 18, 19 opposite insertion openings 9 as a support for the other retaining bolt.

The hydraulic or pneumatic drive 11 is disposed between the two plates 18, 19 arranged in parallel to each other.

At its free end the piston rod 27 linked with-piston 21 of the hydraulic or pneumatic drive 11 is shaped as a threaded bolt 29 in a constructionally simple manner and screwed into a threaded bore 30 on the rear of gripper 6.

Due to the special constructional design as a block with the cylinder 20 of the hydraulic drive 11 all lines and unlockable non-return valves and also other hydraulic switching and control elements can be integrated into said block, whereby only two connection elements 22 for the necessary pressure lines are left leading to the outside.

The invention claimed is:

1. An assembly for exchangeably fastening an implement to an excavator boom comprising:

retaining bolts (4, 5) spaced apart (A) in parallel disposed on the implement:

first and second grippers (6, 7) disposed on a mounting bar (23) on the excavator boom for gripping the retaining bolts (4, 5);

the grippers (6, 7) providing open insertion openings (8, 9) for the retaining bolts (4, 5) in directions facing away from each other, and are adjustable relative to each other using a hydraulically or pneumatically operated drive (11);

a longitudinal axis (10) of the hydraulic or pneumatic drive (11), a center axis (12, 13) of the retaining bolts (4, 5), and a center axis (14, 15) of the insertion openings (8, 9) on the grippers (6, 7) are arranged, at least approximately, in one plane (16);

the first gripper (7) being fixedly and non-displaceably disposed on the mounting bar (23) of the excavator boom, and a cylinder (20) of the hydraulic or pneumatic drive (11) being connected with the mounting bar (23) and thus with the first gripper (7); and the second gripper (6) linked with a piston (21) of the hydraulic or pneumatic drive (11) for adjustable positioning, the second gripper (6) operates within a guide (17) formed by plates (18, 19) located on both sides of the guide, the plates are arranged parallel to each other, and parallel to a direction of the axis of the drive (11); and cut-outs (26) shaped as circular arcs are formed on the ends of the plates (18, 19) opposite the insertion openings (9) as a support for the other retaining bolt (4).

2. The assembly according to claim 1, characterized in that said plates (18, 19) extend to form gripper mounting bars (24, 24*a*), whereby the cylinder (20) of the hydraulic or pneumatic drive (11) is firmly attached to a crossbar (25) inserted between the gripper mounting bars (24, 24*a*).

3. The assembly according to claim 1, characterized in that the first gripper (7) is formed by the plates (18, 19), which are each provided with the insertion opening (9) for positively locking onto the retaining bolt (5).

4. The assembly according to claim 3, characterized in that, the hydraulic or pneumatic drive (11) is disposed between the two plates (18, 19).

5. The assembly according to claim 1 characterized in that, a piston rod (27) linked with the piston (21) of the hydraulic or pneumatic drive (11) is shaped as a threaded bolt (29) at its free end and is screwed into a threaded bore (30) on a gear portion of the second gripper (6).

6. The assembly according to claim 1, characterized in that all pressure lines and unlockable non-return valves are integrated into a block formed by the cylinder (20) of the hydraulic or pneumatic drive (11), whereby two connection elements (22) for the pressure lines are left leading to the outside.

* * * * *